US005582062A

United States Patent [19]

Sommer

[11] Patent Number: 5,582,062

[45] Date of Patent: Dec. 10, 1996

[54] DIE CHANGING SYSTEM INCLUDING MOVING BOLSTERS

[75] Inventor: Gordon M. Sommer, Grosse Pointe Farms, Mich.

[73] Assignee: Midwest Brake Bond Company, Warren, Mich.

[21] Appl. No.: 431,362

[22] Filed: Apr. 28, 1995

[51] Int. Cl.[6] ..... B21D 37/04; B21J 13/00

[52] U.S. Cl. ..... 72/448; 100/918; 83/563; 483/28

[58] Field of Search ..... 72/446, 448; 100/229 R, 100/918; 83/563; 483/28

[56] References Cited

U.S. PATENT DOCUMENTS

| | | | |
|---|---|---|---|
| 3,422,660 | 1/1969 | Countess, Jr. et al. | 72/448 |
| 3,986,448 | 10/1976 | Seyfried et al. . | |
| 4,433,620 | 2/1984 | Kiyosawa . | |
| 5,040,404 | 8/1991 | Henderson et al. | 72/448 |
| 5,121,538 | 6/1995 | Kerr . | |
| 5,129,254 | 7/1992 | Keizer et al. | 72/448 |
| 5,182,934 | 2/1993 | Herdzina et al. . | |
| 5,242,357 | 9/1993 | Kerr . | |
| 5,277,687 | 1/1994 | Shimoichi et al. . | |

*Primary Examiner*—David Jones
*Attorney, Agent, or Firm*—Harness, Dickey & Pierce, P.L.C.

[57] ABSTRACT

A die changing system for a press includes a single push-pull drive system and a double push-pull drive system which move roller supported bolsters along a T-shape track system. Each bolster includes a stationary set of rollers to roll along one section of the T-shaped track system and a retractable set of rollers to roll along the other section of the T-shaped track system. The retractable rollers are moved utilizing a pressurized hydraulic fluid system. Each drive system includes a two speed oil-shear drive which operates at high speed to rapidly move the bolster to a near-final position and then switches to low speed to provide an accurate final positioning for the bolster and its associated die set.

24 Claims, 11 Drawing Sheets

20
132
132
38
38
130
34
32
30
130
34
32
36
36
130
130

38
20
64
128
92
126
66
68
70
90
84
94
108
72
76
78
80
82
86
80
88
12

106
126
128
64
102
96
120
76
124
98
108
104
18
100
78
122

Fig-12
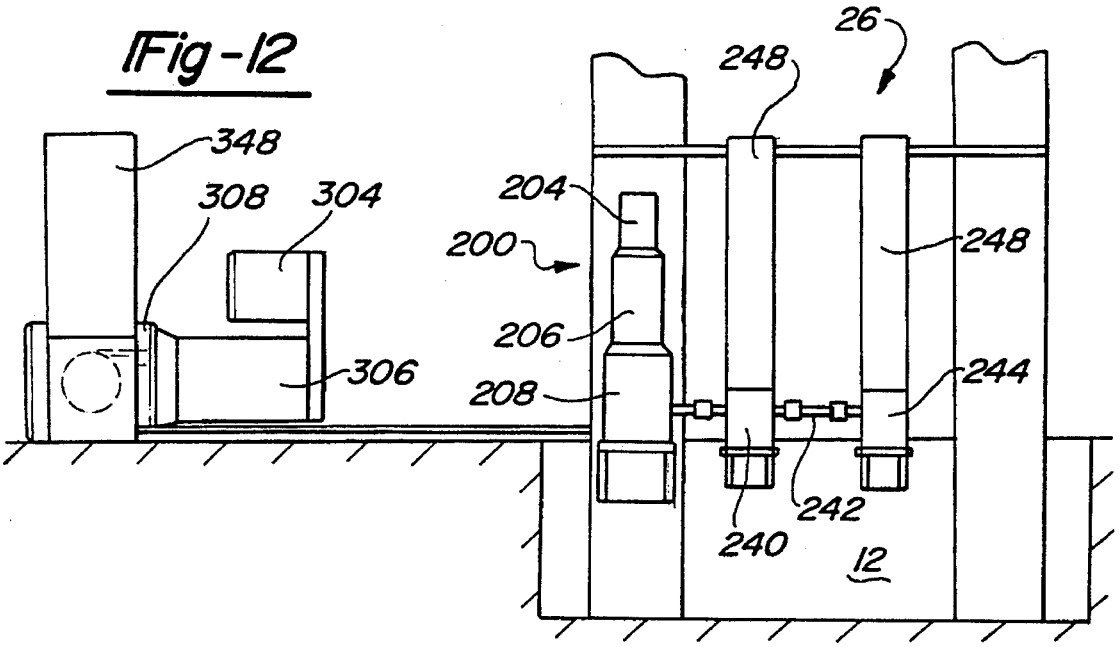
Fig-14
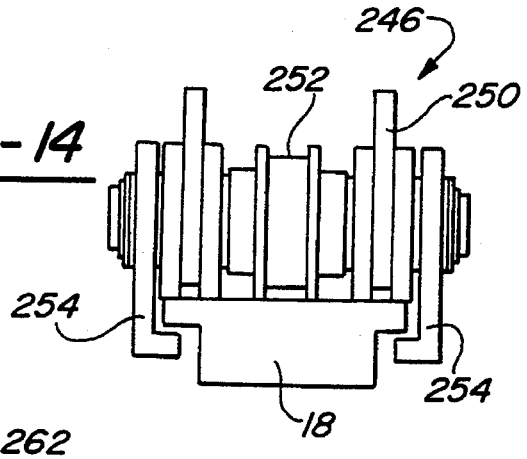
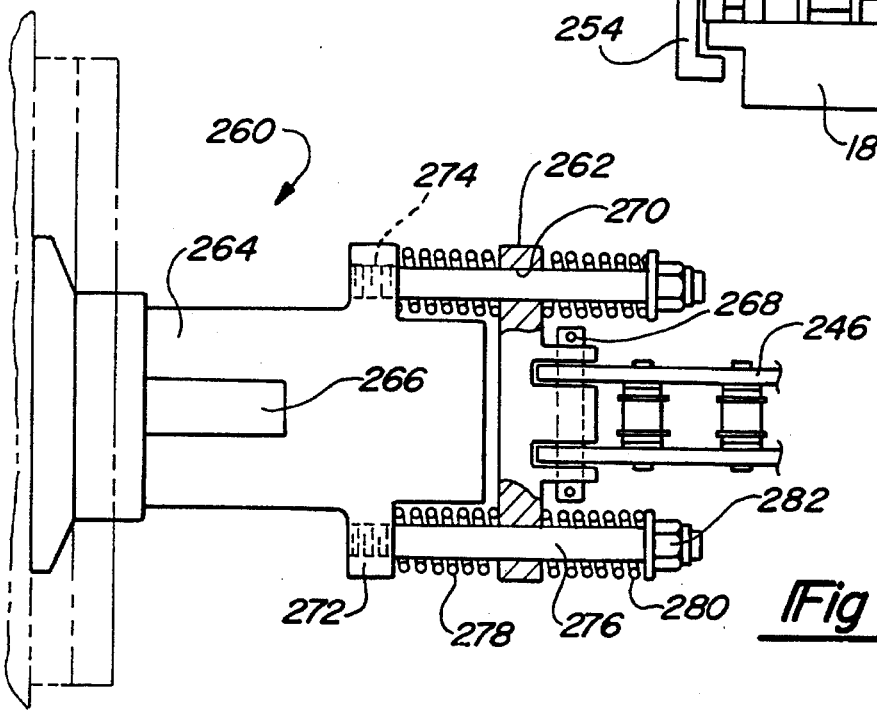
Fig-15

DIE CHANGING SYSTEM INCLUDING MOVING BOLSTERS

FIELD OF THE INVENTION

The present invention relates to a system for changing die sets in a press with the die sets being located on a moving bolster in a press which has an upright opening. More particularly, the present invention relates to a system for coupling and moving the bolsters which support the die sets in order to improve the speed and efficiency of making a die change in the press.

BACKGROUND OF THE INVENTION

Large presses are well known for making large items such as automobile components by pressing a metal blank. Typically, such presses include a press body and a pressing apparatus for pressing a metallic blank inserted intermediate the pressing apparatus and a die set positioned on a bolster. It is a continuing problem in this art to provide a means for changing the die sets in the press when the die sets are positioned on a moving bolster.

A typical die set utilizes a moving bolster to assist in the movement and positioning of the die set within the press. For a die set change, the bolster supporting the existing die set is withdrawn from the press. Thereafter, a second bolster supporting a second die set is moved into position within the press and secured at that point.

The productivity of a press is directly related to the amount of operating time for the press, and thus the number of pieces that the press produces. One factor which has reduced the operating time for the press has been the change in the manufacturing community to a "just in time" supply system. The manufacturing community has been moving toward and is now demanding that suppliers operate under a "just in time" supply environment. While large numbers of a particular part can be pressed from a single die set before requiring changing of die sets due to die wear, the "just in time" supply environment requires fewer parts to be made before a die set change is required to manufacture a different component and not because of excessive die wear.

"Just in time" supply requirements have thus increased the frequency of die set changes due to the minimization of inventory of a particular part due to cost reasons. The increased frequency of die set changes has decreased the productivity of the presses due to the idle time when die set changes are being made. Thus it is desirable to move the bolsters supporting the die sets as quickly as possible, while avoiding damage to the equipment for failing to stop the die sets adequately given the large size and weight of these die sets.

While various prior art systems have been developed which are directed towards increasing the speed and efficiency of die changes, continued development of moving bolsters and systems for moving the bolsters are directed towards a simpler and more efficient apparatus and system for making die set changes.

SUMMARY OF THE INVENTION

The present invention provides the art with a moving bolster which includes two sets of rollers for moving the bolster along a generally T-shaped track. One of the two sets of rollers is movable between an extended and a retracted position under the influence of hydraulic pressure. Once positioned by the movable rollers, the bolster moves along the track by being pushed or pulled by one of two push-pull chain drive systems. The push-pull chain drive systems are powered utilizing a two speed oil-shear drive system which is capable of accurately positioning the bolsters at prespecified positions along the tracks. Each bolster includes means for automatically coupling and decoupling the bolster with either of the two push-pull chain drive systems as well as a second bolster which is waiting to be placed in the press. This automatic coupling and decoupling of the bolsters with the push-pull chain drive systems and/or the adjacent bolster simplifies the operation of the two push-pull chain drive systems and the oil-shear drive systems.

Other advantages and objects of the present invention will become apparent to those skilled in the art from the subsequent detailed description, appended claims and drawings.

BRIEF DESCRIPTION OF THE DRAWINGS

In the drawings which illustrate the best mode presently contemplated for carrying out the present invention:

FIG. 12 is a side elevational view illustrating the single push-pull drive system in accordance with the present invention;

FIG. 14 is an end view taken along the track in the press shown in FIGS. 1 and 2 to illustrate the interface between the single push-pull chain and the track;

FIG. 15 is a plan view of the driving end of the single push-pull chain according to the present invention;

DETAILED DESCRIPTION OF THE PREFERRED EMBODIMENT

Figure 1:
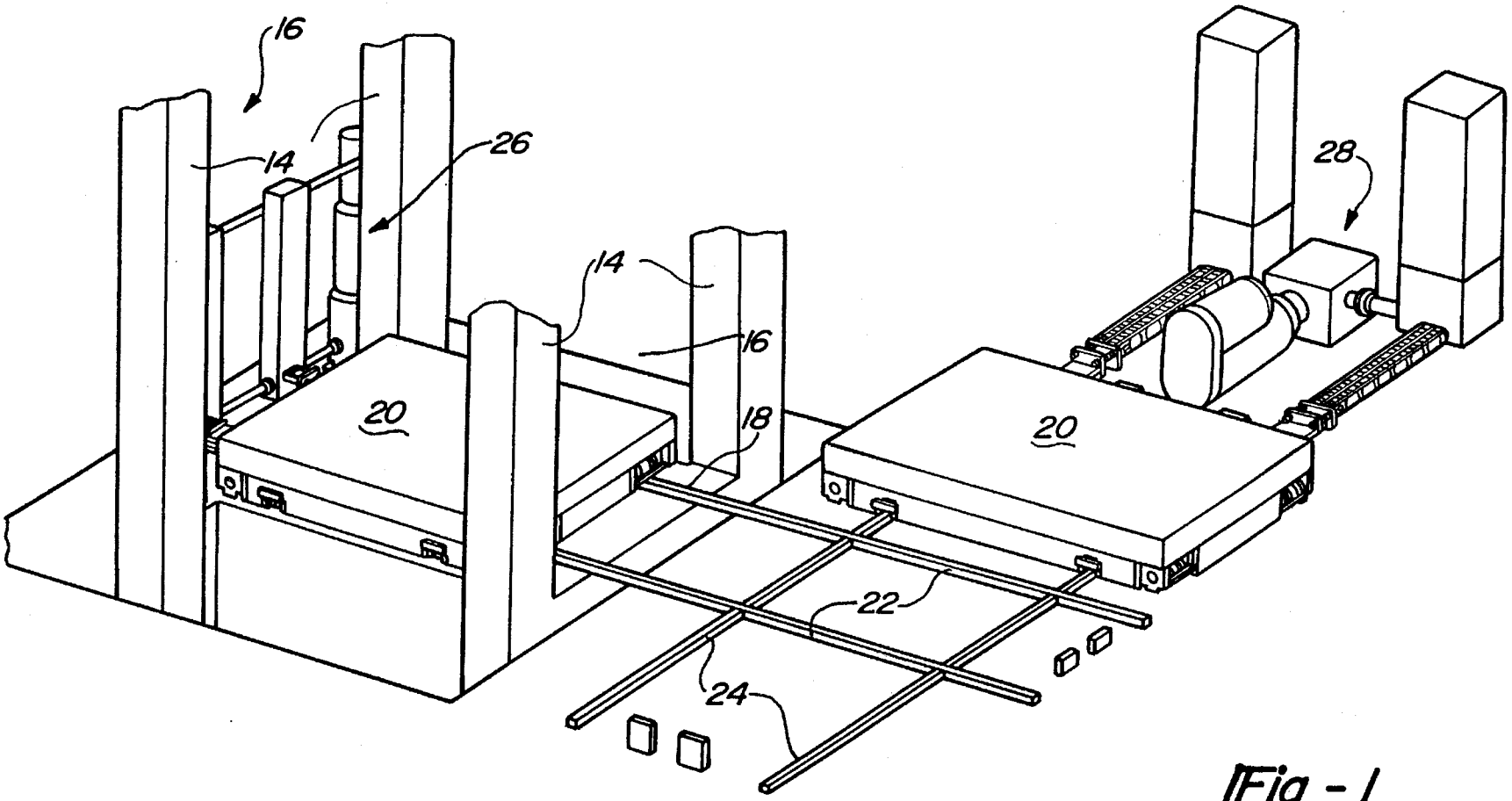
FIG. 1 is a schematic perspective view showing the moving bolster and drive system in accordance with the present invention.

Referring now to the drawings in which like reference numerals designate like or corresponding parts throughout the several views, there is shown in FIG. 1 a press which is designated generally by the reference numeral 10. The portion of press 10 which is shown is the lower-most portion comprising a press bed 12 and uprights 14 which extend upwardly from opposite sides of press bed 12 and which at the top are connected to a press crown (not shown) which contains the mechanism for actuating the press slide which is reciprocal in the vertical direction toward and away from bed 12.

Uprights 14 define side openings 16 which provide access to bed 12. Bed 12 on the upper surface thereof is provided with spaced parallel hat-shaped tracks 18 which are secured to and extend above the upper surface of bed 12. Tracks 18 extend across bed 12 between side openings 16 for engagement with a bolster 20 as will be described later herein.

Externally of press 10 there is provided a pair of spaced parallel hat-shaped tracks 22 which register with track 18 on bed 12. Hat-shaped tracks 22 also engage a bolster 20 as will be described later herein. Additionally, there is provided a pair of spaced parallel hat-shaped tracks 24 which extend generally perpendicular to hat-shaped tracks 22 to form a generally T-shaped rail assembly for transporting bolsters 20 in and out of press 10.

A first drive system 26 is connected to press 10 in alignment with tracks 18 and 22. Drive system 26 is a single push-pull chain drive system which operates to move bolster 20 up and down tracks 18 and 22 during the die change operation. A second drive system 28 is connected to one end of tracks 24. Drive system 28 is a double push-pull chain drive system which operates to move bolsters 20 back and forth along tracks 24 during a die change operation to position the appropriate bolster 20 in alignment with tracks 18 and 22 as will be described later herein.

Figure 2:
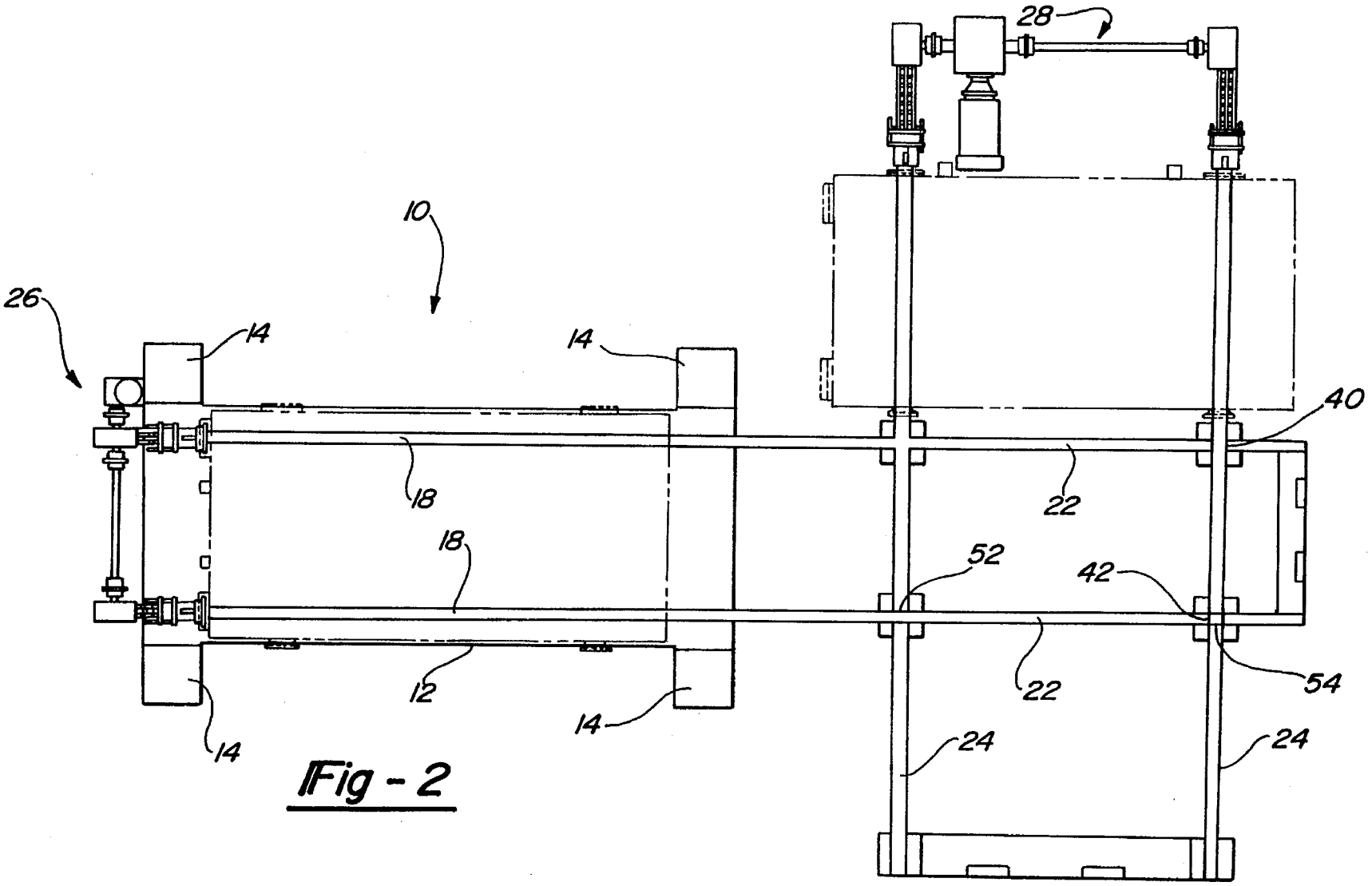
FIG. 2 is a plan view showing the press, moving bolsters and drive system, in accordance with the present invention.
Figure 3:
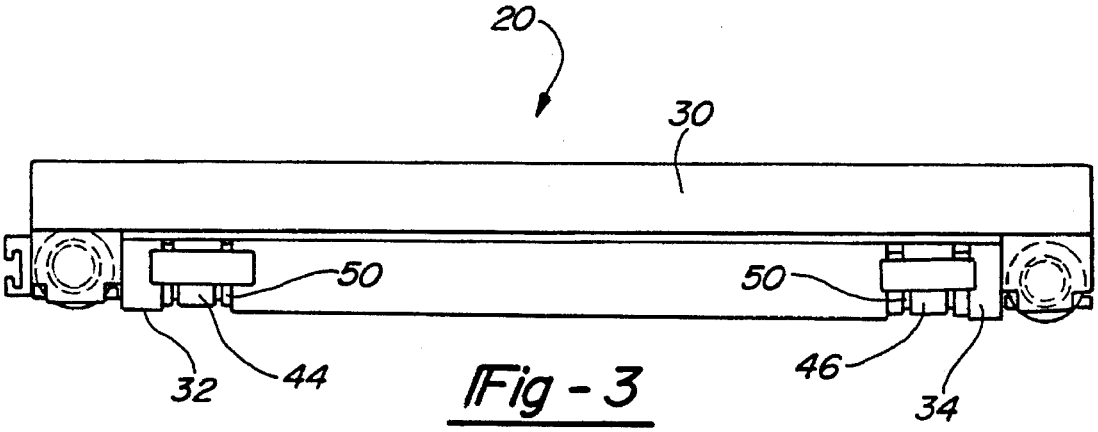
FIG. 3 is a front elevational view of a bolster in accordance with the present invention.
Figure 4:
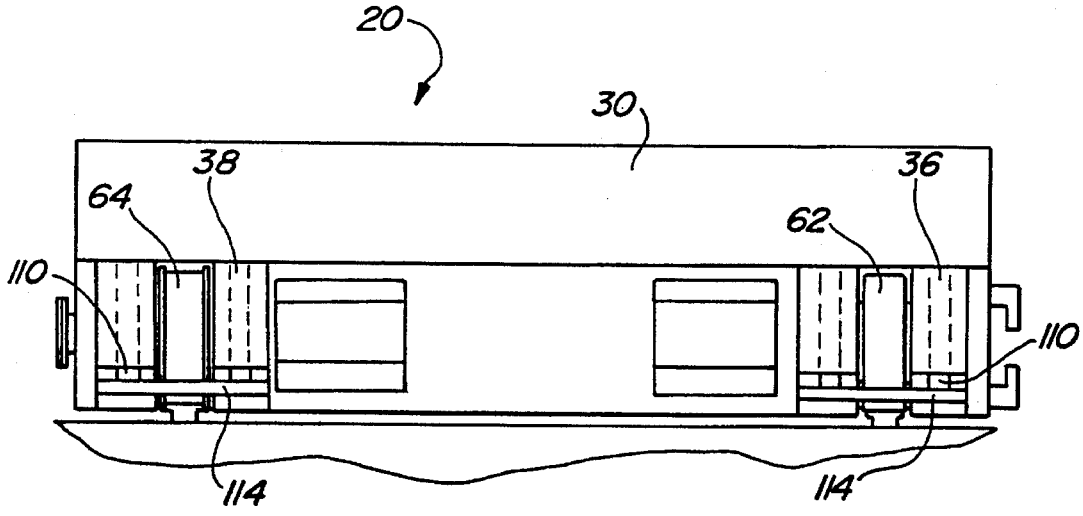
FIG. 4 is a side elevational view of the bolster shown in FIG. 3.

Referring now to FIGS. 3 through 6, bolster 20 is illustrated in greater detail. Bolster 20 includes a base 30, two stationary roller assemblies 32, two stationary flanged roller assemblies 34, two retractable roller assemblies 36 and two retractable flanged roller assemblies 38. Stationary roller assemblies 32 are each positioned at an opposing corner of base 30 and are positioned to mate with one of the two tracks 24 to facilitate the movement of bolster 20 along tracks 24. Stationary flanged roller assemblies 34 are each positioned at an opposing corner of base 30 along the side of base 30 opposite to stationary roller assemblies 32. The position of flanged roller assemblies 34 allow them to engage the other of the two tracks 24 to guide and facilitate the movement of bolster 20 along tracks 24. As can be seen in FIG. 2, tracks 22 are relieved at 40 and 42 to allow flanged roller assemblies 34 to move along track 24 without interfering with track 22. The opposite end of bolster 20 is provided with stationary roller assemblies 32 which do not include flanges and thus do not require the relieving of track 22.

Stationary roller assemblies 32 are similar to stationary flanged roller assemblies 34 with the only difference being that roller assemblies 32 include a non-flanged roller 44 whereas roller assemblies 34 include a flanged roller 46. Both rollers 44 and 46 have the same overall width and are rotatably secured to base 30 using bearings 50.

In a similar manner, retractable roller assemblies 36 are each positioned at an opposing corner of base 30 and are positioned to mate with one of the two tracks 18 and one of the two tracks 22 to facilitate the movement of bolster 20 along tracks 18 and 22. Retractable flanged roller assemblies 38 are each positioned at an opposing corner of base 30 along the side of base 30 opposite to retractable roller assemblies 36. The position of flanged roller assemblies 38 allow them to engage the other of the two tracks 18 and the other of the two tracks 22 to guide and facilitate the movement of bolster 20 along tracks 18 and 22. As can be seen in FIG. 2, tracks 24 are relieved at 52 and 54 to allow flanged roller assemblies 38 to move along tracks 18 and 22 without interfering with track 24. The opposing end of bolster 20 is provided with retractable roller assemblies 36 which do not include flanges and thus do not require the relieving of track 22.

Figure 6:
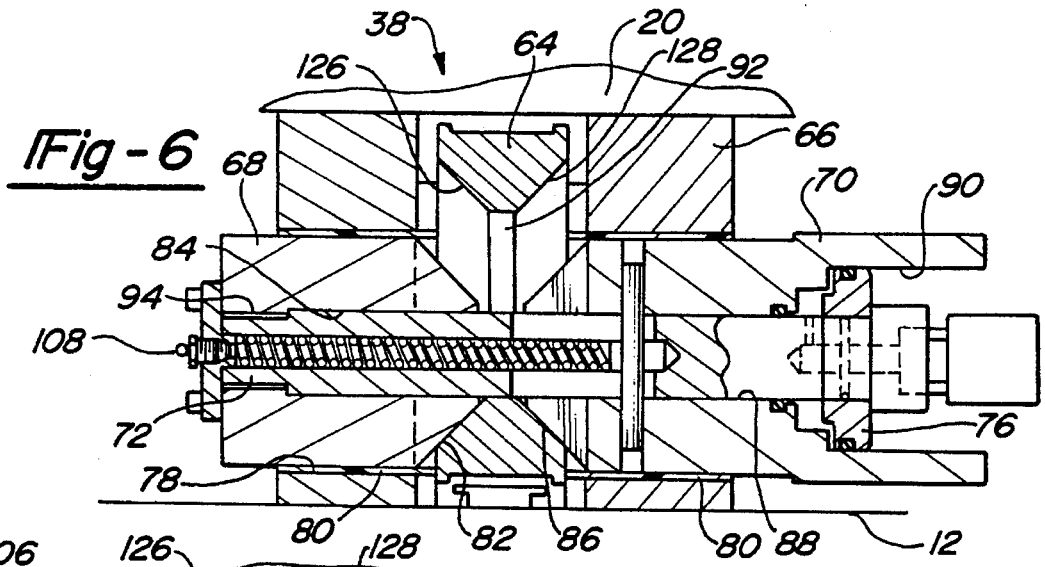
FIG. 6 is an enlarged elevational view of the retractable roller assembly of the bolster shown in FIG. 3 with the roller in the retracted position.
Figure 7:
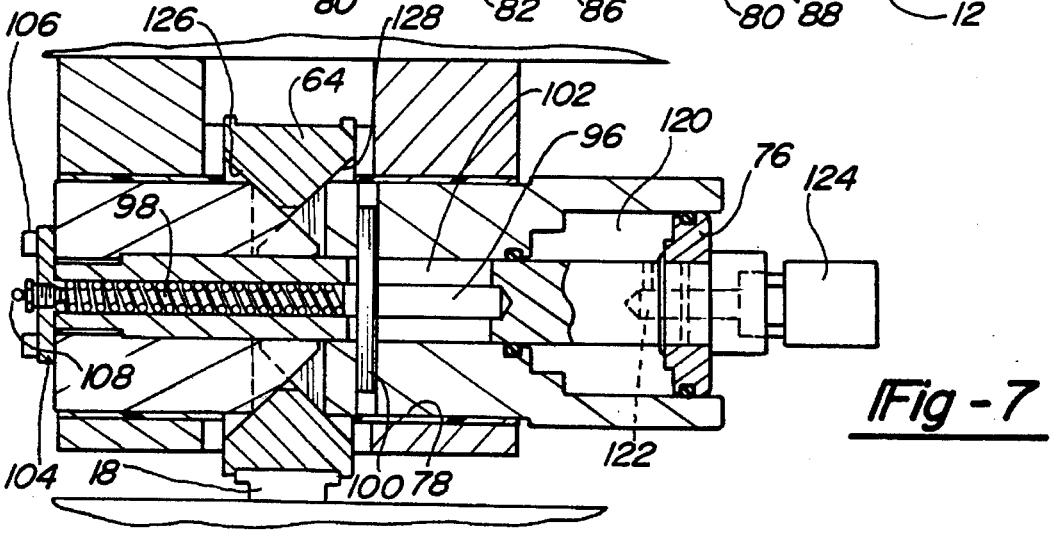
FIG. 7 is a view similar to FIG. 6 but showing the roller in its extended position.

Retractable roller assemblies 36 and retractable flanged roller assemblies 38 are each provided with a hydraulic system 60. Hydraulic system 60 is identical for both roller assemblies 36 and 38 with the only difference being that system 60 retracts and extends a non-flanged roller 62 in roller assemblies 36 whereas system 60 retracts and extends a flanged roller 64 in roller assemblies 38. For an exemplary detailed description of hydraulic system 60, FIGS. 6 and 7 illustrate retractable flanged roller assembly 38 having flanged roller 64. It is to be understood that identical hydraulic systems 60 are incorporated into retractable roller assemblies 36 to retract and extend non-flanged roller 62. Both rollers 62 and 64 have the same overall width and engage hydraulic system 60 in an identical manner. Rollers 62 and 64 are slightly narrower than rollers 44 and 46 which thus requires them to be slightly larger in diameter than rollers 44 and 46 in order to support the same load in a similar manner.

Hydraulic system 60, shown in FIGS. 6 and 7 comprise flanged roller 64, a mounting frame 66, a first housing 68, a second housing 70, a connecting rod 72 and a piston 76. Mounting frame 66 is fixedly secured to bolster 20 by methods known well in the art. Frame 66 defines a cylindrical chamber 78 within which is located a pair of low friction bushings 80. Bushings 80 are provided to engage housing 68 and housing 70 in order to facilitate the relative movement of these components.

First, housing 68 is located within one end of chamber 78 and within one of the two bushings 80. The external surface of first housing 68 includes a camming/bearing surface 82 for engaging roller 64. First housing 68 moves longitudinally within chamber 78 to retract and extend roller 64. First housing 68 further defines an internal bore 84 which accepts connecting rod 72 as will be described later herein.

Second housing 70 is located in the opposite end of chamber 78 and within the other of the two bushings 80 such that roller 64 is disposed between first and second housings 68 and 70. The external surface of second housing 70 includes a camming/bearing surface 86 for engaging roller 64. Second housing 70 further defines an internal bore 88 which slidingly engages connecting rod 72 at one end and defines a piston cavity 90 at the opposite end. Second housing 70 also moves longitudinally within chamber 78 to retract and extend roller 64 as will be described later herein.

Connecting rod 72 extends between first housing 68 and second housing 70 through a centralized bore 92 defined by roller 64. Connecting rod 72 is fixedly secured to first housing 68 by a thread 94 or by other means known well in the art. Connecting rod 72 extends from first housing 68 through bore 92 of roller 64, through bore 88 of second housing 70 and into piston cavity 90. The outside diameter of connecting rod 72 and the inside diameter of bore 88 are sized such that second housing 70 is able to slide longitudinally along connecting rod 72. Connecting rod 72 defines an internal bore 96 within which is disposed a coil spring 98 which urges first and second housings 68 and 70 away from each other. Coil spring 98 reacts against a cross pin 100 which is secures within second housing 70 and which extends through a slot 102 extending through connecting rod 72 to allow movement of connecting rod 72 with respect to second housing 70. The opposite end of coil spring 98 reacts against a cover plate 104 which is secured to first housing 68 by a plurality of bolts 106. A grease fitting 108 extends through cover plate 104 and into internal bore 96 to allow for the lubrication of the interface between the outside surface of connecting rod 72 and the internal surface of bore 88 in second housing 70. Lubricant is allowed to reach this interface through slot 102.

Figure 8:
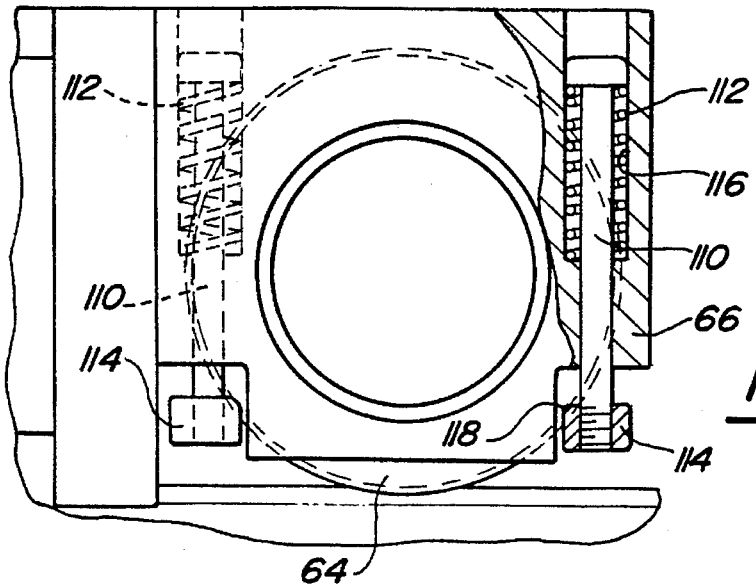
FIG. 8 is a side elevational view of the retractable roller assembly showing the biasing system for urging the roller assembly into its fully retracted position.

Referring now to FIG. 8, the unrestricted movement of bolster 20 along track 24 requires that roller 64 be biased upward to its fully retracted position in order to avoid any interference with tracks 22. The biasing of each roller 64 as well as each roller 62 into their fully retracted position is accomplished by utilizing four bolts 110, four coil springs 112 and two bars 114. Each bolt 110 is disposed within a respective stepped bore 116 with one stepped bore 116 being located at each corner of mounting frame 66. Each bar 114 is threadingly engaged by two bolts 110 which extend through a respective stepped bore 116 such that each bar extends across roller 64 generally parallel to the axis of rotation of roller 64. Each bolt 110 is biased upward by a respective coil spring 112 which is also disposed within each stepped bore 116 and thus each bar 114 is biased upward by two coil springs 112 reacting between the step in bore 116 and the head of bolt 110. Each bar 114 includes a contoured surface 118 which mates with flanged roller 64 and thus biases flanged roller 64 into its fully retracted position. The biasing of roller 62 is identical to the biasing of roller 64.

Referring back to FIGS. 6 and 7, piston 76 is disposed within piston cavity 90 for longitudinal movement therein. Piston 76 is fixedly secured to the end of connecting rod 72 which extends into piston cavity 90. Piston 76 and piston cavity 90 defining a sealed hydraulic chamber 120 which is supplied with pressurized hydraulic fluid through a passageway 122 extending through connecting rod 72. A rotary union 124 is provided at the outside opening of passageway 122 to facilitate the supply of the pressurized hydraulic fluid to chamber 120.

FIGS. 6 and 7 illustrate the extension and retraction of flanged roller 64 which is also illustrative of the extension and retraction of non-flanged roller 62. FIG. 6 illustrates the retracted position of roller assembly 36 and it occurs when there is no pressurized fluid being supplied to hydraulic chamber 120 through passageway 122. In FIG. 6, the bottom of bolster 20 rests against the top of bed 12. When it is desired to raise bolster 20, pressurized hydraulic fluid is supplied to chamber 120 through passageway 122 causing the movement of piston 76 within piston cavity 90 and the movement of first and second housing 70 within chamber 78. Camming/bearing surfaces 82 of first housing 68 reacts against a camming/bearing surface 126 located on one side of roller 64 and camming/bearing surface 86 of second housing 70 reacts against a camming/bearing surface 128 located on the opposite side of roller 64 to extend roller 64 beyond the bottom surface of bolster 20 to raise bolster 20 and support it on tracks 18. Both first and second housings 68 and 70 are relieved on their ends to allow for the overlap shown in FIG. 7. This movement of roller 64 is against the load exerted by coil spring 98 and the load exerted by coil springs 112. In the preferred embodiment roller 64 is extended one and one-quarter of an inch. When it is desired to lower bolster 20, pressurized fluid is released from chamber 120 through passageway 122 and bolster 20 will come to rest on the base of bed 12 or on tracks 24 as will be described later herein. Coil spring 98 and the plurality of coil springs 112 insure that roller 64 will be positioned in its fully retracted position upon the release of hydraulic pressurized fluid.

Figure 5:
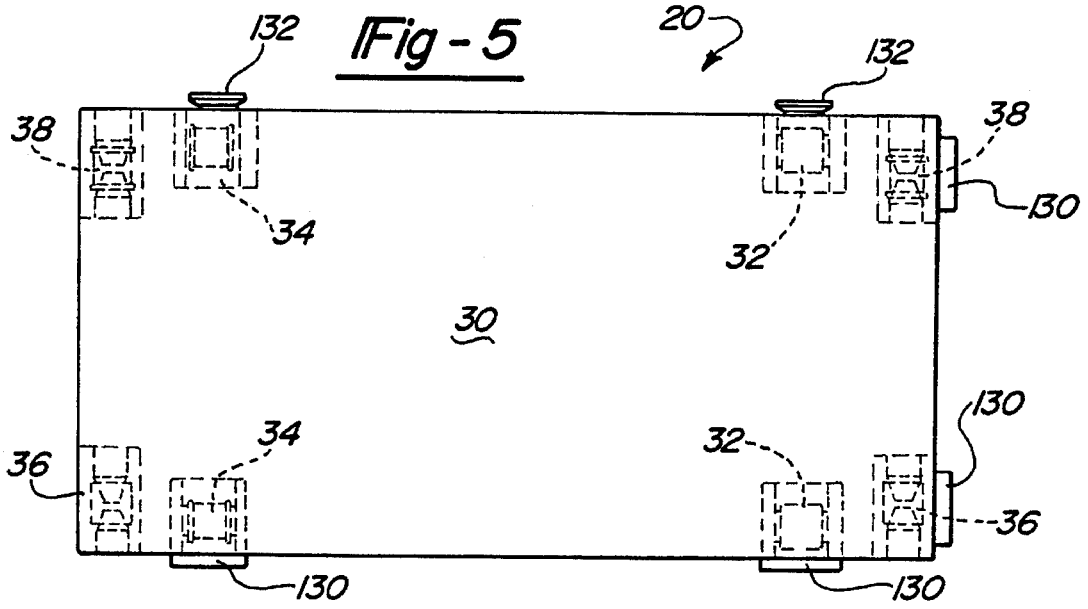
FIG. 5 is a plan elevational view of the bolster shown in FIG. 3.

Referring now to FIG. 5, each bolster 20 is provided with means for coupling the bolster with first drive system 26, second drive system 28 and with an adjacent bolster 20. The coupling means comprises a female coupling 130 and a male coupling 132. While the present invention will be described as having female and male couplings 130 and 132 being located at specific locations, it is within the scope of the present invention to reverse the positions of the corresponding male and female couplings if desired. Bolster 20 is provided with two sets of female couplings 130 and one set of male couplings 132. Each drive system 26 and 28 is provided with one set of male couplings 132.

Figure 10:
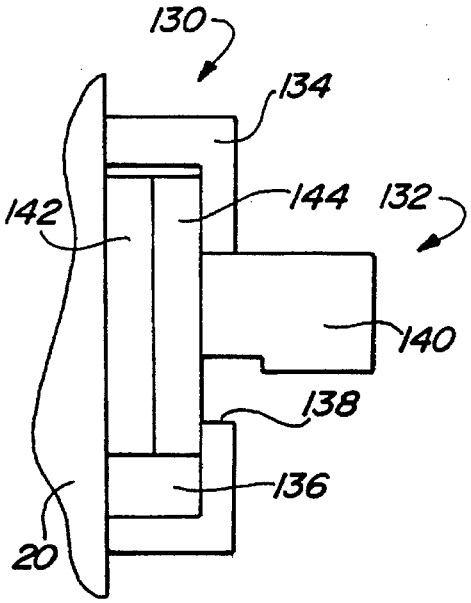
FIG. 10 is a side elevational view of the coupling means shown in FIG. 9.
Figure 9:
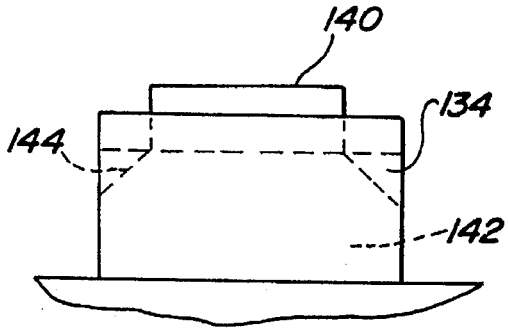
FIG. 9 is a plan elevational view of the coupling means in accordance with the present invention.

Referring now to FIGS. 9 and 10, female coupling 130 comprises a pair of L-shaped brackets 134 which are secured to the side of bolster 20 such that they define an internal cavity 136 and a slot 138. Male coupling 132 comprises a generally rectangular shaped body 140 having an enlarged head 142 which is attached to body 140 through a tapered section 144.

When bolster 20 is moved longitudinally with respect to drive systems 26 and 28 or with respect to an adjacent bolster 20, male coupling 132 engages female coupling 130 by having enlarged head 142 engage internal cavity 136 as shown in FIG. 10. Tapered section 144 allows for a slight misalignment between head 142 and cavity 136 to facilitate the coupling of the two components. At the same time head 142 and tapered section 144 engage internal cavity 136, rectangular shaped body 140 engages slot 138. As can be seen in FIG. 10, cavity 136 and slot 138 are wider than the height of head 142 and body 140, respectively, to provide clearance to allow for the raising and lowering of bolster 20. As can be seen in FIGS. 1, 2 and 5, bolster 20 has a pair of female couplings 130 on the longitudinal side which is or will be adjacent to drive system 26, a pair of female couplings 130 on the side which is or will be adjacent to drive system 28 and a pair of male couplings 132 on the longitudinal side opposite to the side which is or will be adjacent to drive system 28. Both drive systems 26 and 28 include a pair of male couplings 132.

Figure 11A:
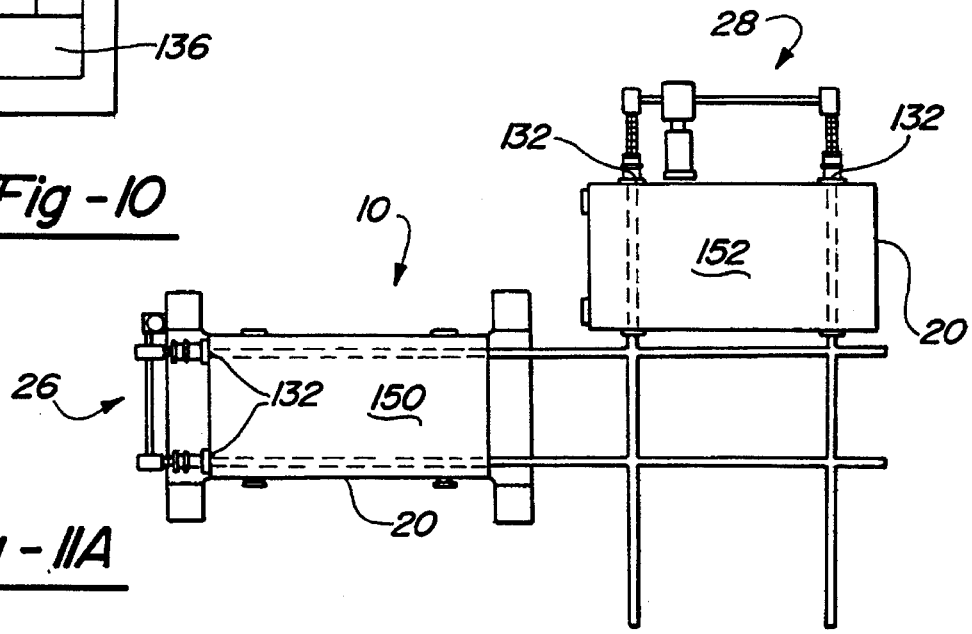
FIGS. 11*a*–11*d* schematically illustrate the sequence for the die changing system in accordance with the present invention.

FIGS. 11*a* through 11*d* illustrate the die changing operation for press 10. FIG. 11*a* illustrates press 10 having a first die 150 being disposed on a bolster 20 within press 10 and a second die 152 disposed on a second bolster 20 disposed on tracks 24. The die change operation begins by raising the bolster carrying die 150 located within the press to support bolster 20 and die 150 on track 18 within press 10. This in accomplished by providing pressurized hydraulic fluid to fluid chambers 120 of roller assemblies 36 and 38 which extend rollers 62 and 64 approximately one and one-quarter of an inch in the preferred embodiment.

Figure 11B:
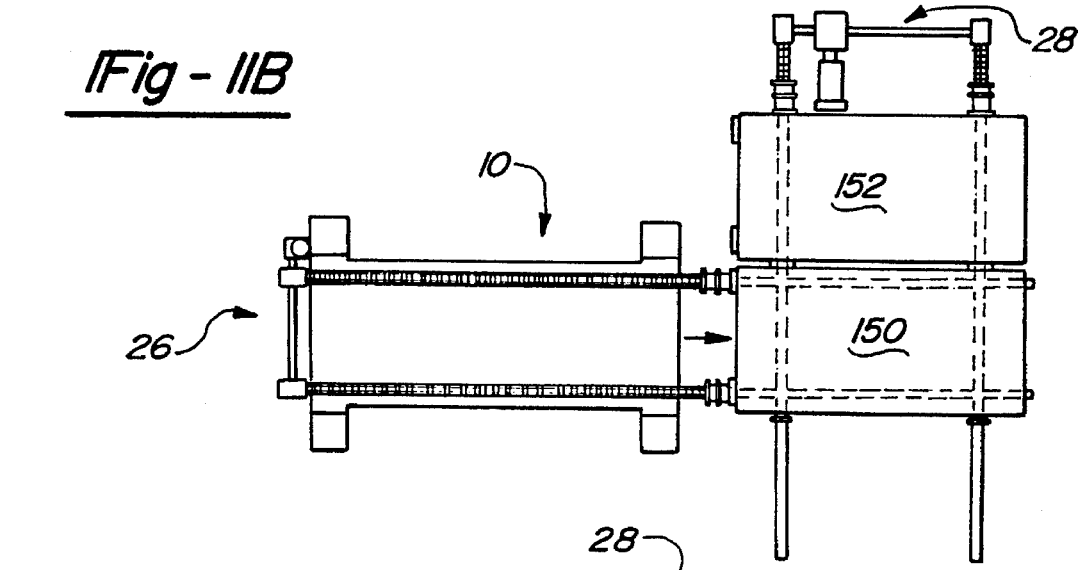

Drive system 26 is then activated to push bolster 20 and die 150 along tracks 18 onto tracks 22 as shown in FIG. 11*b*. Drive system 26 continues to push bolster 20 which rolls along tracks 18 and 22 on rollers 62 and 64 until rollers 44 and 46 of stationary roller assemblies 32 and 34 are in alignment with tracks 24. During the movement of bolster 20 along tracks 18 and 22, the direction of travel of bolster 20 and die 150 is guided by flanged rollers 64 of roller assemblies 38 which are in engagement with tracks 18 and 22. Also, during the movement of bolster 20 and die 150 along tracks 18 and 22, female couplings 130 on bolster 20 carrying die 150 engage male couplings 132 on bolster 20 carrying die 152.

Upon reaching the aligned position of rollers 44 and 46 with tracks 24, fluid pressure is released from fluid chambers 120 of roller assemblies 36 and 38 of bolster 20 carrying die 150. This retracts rollers 62 and 64 and bolster 20 is lowered approximately three-eighths of an inch, in the preferred embodiment, to engage stationary rollers 44 and 46 with tracks 24. Coil springs 98 and 112 urge rollers 62 and 64 into their fully retracted position so they do not interfere with tracks 22 during the movement of bolsters 20 along tracks 24.

Figure 11C:
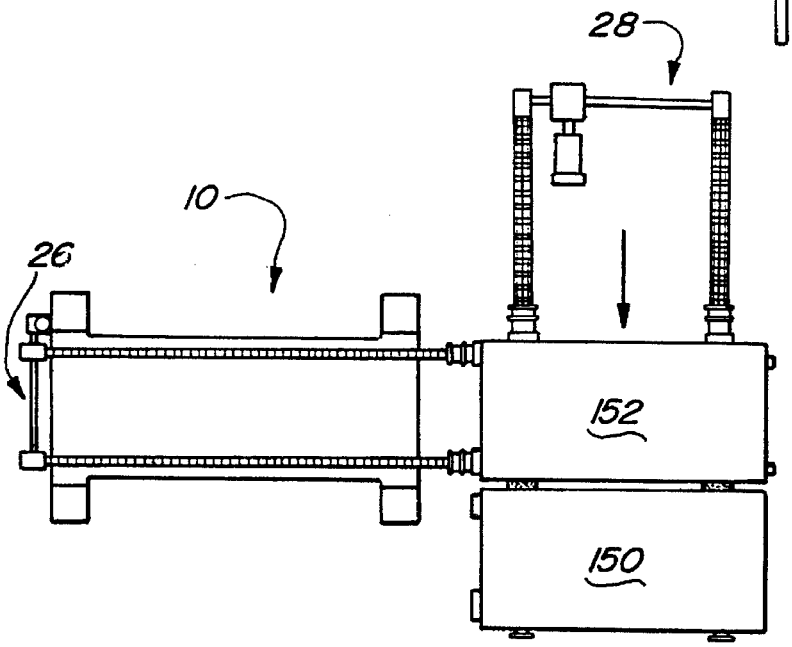

When bolster 20 carrying die 150 is positioned with rollers 44 and 46 on tracks 24, drive system 28 is activated to push bolsters 20 carrying dies 150 and 152 along tracks 24 as shown in FIG. 11*c*. This longitudinal movement of bolsters 20 disengages female couplings 130 on bolster 20 carrying die 150 from male couplings 132 on drive system 26 and subsequently engages female couplings 130 on bolster 20 carrying die 152 with male couplings 132 on drive system 26. During the movement of bolsters 20 along tracks 24, the direction of travel of bolsters 20 is guided by flanged rollers 46 of roller assemblies 34 which are in engagement with tracks 24. The movement of both of the bolsters 20 continues until rollers 62 and 64 of bolster 20 carrying die 152 are in alignment with tracks 22.

Upon reaching the aligned position of bolster 20 carrying die 152 and tracks 22, bolster 20 carrying die 152 is raised to support bolster 20 and die 152 on track 22. This is accomplished by providing pressurized hydraulic fluid to fluid chambers 120 of roller assemblies 36 and 38 which extend rollers 62 and 64 approximately one and one-quarter of an inch to raise bolster 20 approximately three-eighths of an inch off of rollers 44 and 46.

Figure 11D:
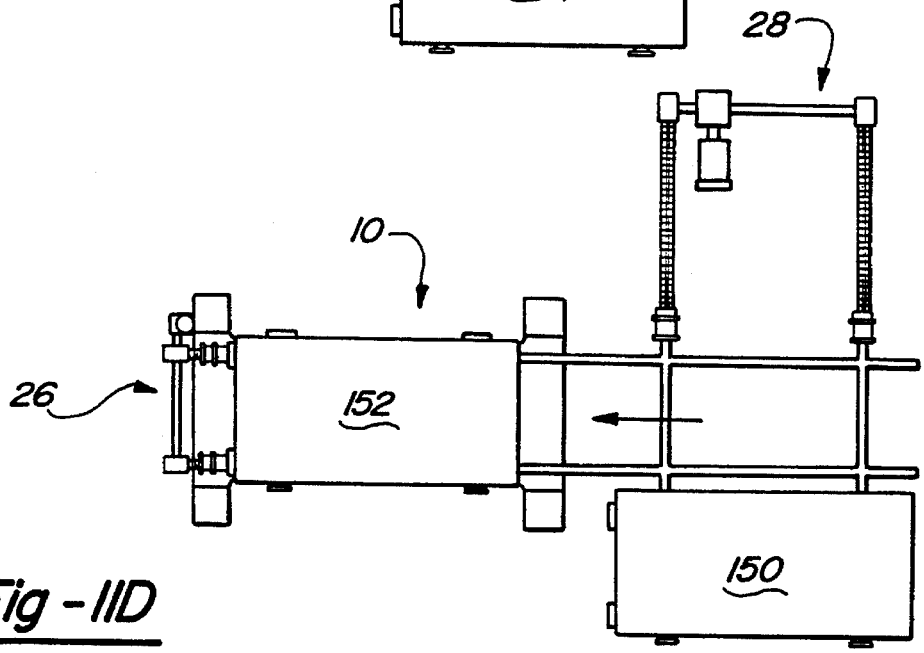

Drive system 26 is again activated to pull bolster 20 and die 152 along tracks 22 and onto tracks 18 as shown in FIG. 11*d*. Drive system 26 continues to pull bolster 20 which rolls along tracks 22 and 18 on rollers 62 and 64 until bolster 20 and die 152 are properly positioned within press 10. During the movement of bolster 20 along tracks 22 and 18, the direction of travel of bolster 20 and die 152 is guided by flanged rollers 64 of roller assemblies 38 which are in engagement with tracks 22 and 18. Also during the movement of bolster 20 and die 152 along tracks 22 and 18, the male couplings 132 on bolster 20 carrying die 152 disengage from the female couplings 130 on bolster 20 carrying die 150. Simultaneously, the female couplings 130 on bolster 20 carrying die 152 disengage from the male couplings 132 on drive system 28.

With bolster 20 and die 152 properly positioned within press 10, as shown in FIG. 11*d*, bolster 20 and die 152 are secured to press 10 and operation of press 10 can begin. Bolster 20 carrying die 150 can remain in place if it is the next die to be scheduled into press 10 or it can be switched with a different bolster 20 and die if desired. When the next change is to take place, the die and bolster in press 10 will be raised, drive system 26 will push the die and bolster out of press 10 and into engagement with the die and bolster waiting as well as drive system 28. At that point drive system 28 will pull both dies and bolsters to disengage the current die and bolster with drive system 26 and engage the waiting die and bolster with drive system 26 which will then pull the new die and bolster into press 10 leaving the original die and bolster as shown in FIG. 11*a* where it can remain or be replaced.

Referring now to FIG. 12, drive system 26 is comprised of a two speed oil-shear drive system 200 and a single push-pull drive apparatus 202. Drive system 200 is mounted to press 10 and comprises a motor 204, a two speed oil-shear drive 206 and a reduction gear 208. Motor 204 and reduction gear 208 are well known in the art and will not be discussed in detail herein. Two speed oil-shear drive 206 is more fully disclosed in assignee's copending U.S. patent application Ser. No. 08/059,585, filed May 10, 1993 and entitled "Electrically Energized Oil-Shear Drive System", the disclosure of which is hereby incorporated herein by reference.

Figure 13:
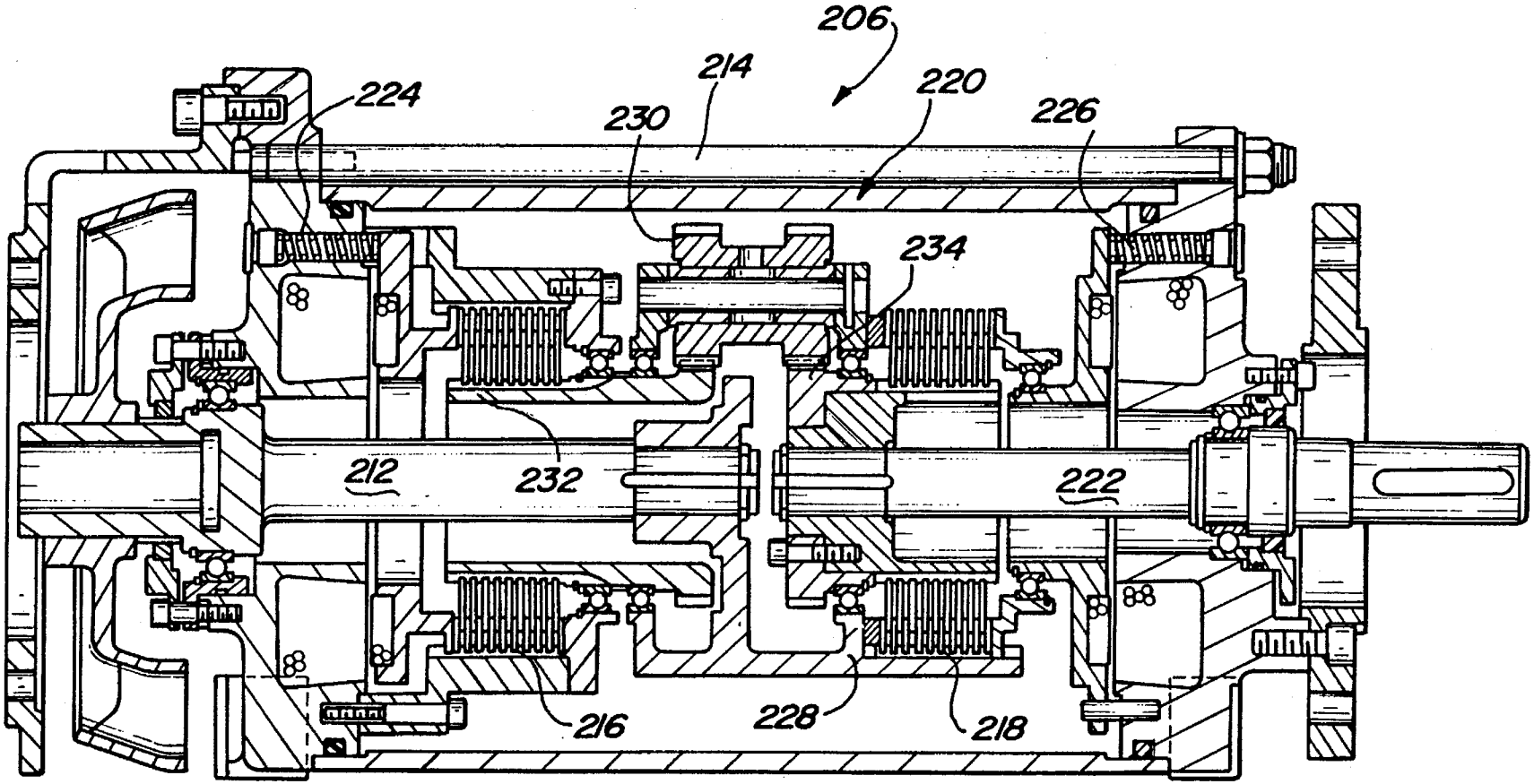
FIG. 13 is a side elevational view, partially in cross-section, of the two speed oil-shear drive illustrated in FIG. 12.

Referring now to FIG. 13, two speed oil-shear drive 206 comprises an input shaft 212, a housing assembly 214, a brake/clutch assembly 216, a brake/clutch assembly 218, a planetary gear train 220 and an output shaft 222, Input shaft 212 is driven by motor 204 which is connected to input shaft 212 by means known well in the art. Output shaft 222 drives reduction gear 208 and is secured to reduction gear 208 by means known well in the art.

The operation of drive 206 begins without power being supplied to drive motor 204, without power being supplied to brake/clutch assembly 216 and without power being supplied to brake/clutch assembly 218. Drive motor 204 is not operating and both assemblies 216 and 218 are in their engaged positions due to the biasing of springs 224 and 226. In this condition, rotational movement of both input shaft 212 and output shaft 222 is prohibited. When power is applied to drive motor 204, it is also simultaneously applied to brake/clutch assembly 216 and brake/clutch assembly 218. The application of power to these components allows input shaft 212 to freely rotate with drive motor 204 due to the disengagement of both brake/clutch assemblies 216 and 218.

From this operating condition, two speed drive 206 can be switched to operate in a high speed or a low speed condition. If high speed operation is desired, power is supplied to assembly 216 and power is terminated to assembly 218. The termination of power to assembly 218 locks the carrier 228 of planetary gear train 220 to output shaft 222 for a direct driving relationship between input shaft 212 and output shaft 222 due to the fact that input shaft 212 drives carrier 228.

If low speed operation is desired, power is terminated to assembly 216 and power is supplied to assembly 218. This termination of power to assembly 216 causes input shaft 212 to transmit rotation to output shaft 222 through planetary gear train 220 to provide a low speed operation. Power is transferred from input shaft 212 and carrier 228 to the planetary gears 230 due to the fact that the input sun gear 232 is locked. Power from the planetary gears 230 is transferred to an output sun gear 234 which directly drives output shaft 222.

The braking of two speed oil-shear drive 206 is accomplished by terminating power to both brake/clutch assemblies 216 and 218 which forces input shaft 212 to attempt to drive output shaft 222 through both planetary gear train 220 and assembly 218 which has the effect of locking planetary gear train 220 and thus provide braking for drive 206.

Referring back to FIG. 12, the output from reduction gear 208 drives a first drive sprocket 240, an intermediate drive shaft 242 and a second drive sprocket 244. Each drive sprocket 240 and 244 drives a respective single push-pull chain 246 to push and pull bolster 20 along tracks 18 and 22. Each drive sprocket 240 and 244 includes a magazine 248 for the storage of chain 246 when it is not disposed along track 18.

Referring now to FIG. 14, the construction of chain 246 is typical for a single chain having the various links 250 and cross pieces 252 with the exception that chain 246 includes an L-shaped bracket 254 located at each side of chain 246 for engagement with track 18. Because chain 246 is a push-pull chain, engagement with track 18 is required in order to eliminate any buckling of chain 246 when it is pushing bolster 20. L-shaped brackets 254, which are disposed along the entire length of chain 246, provide the required stability to chain 246 to allow it to push bolster 20 and the associated die set.

Figure 16:
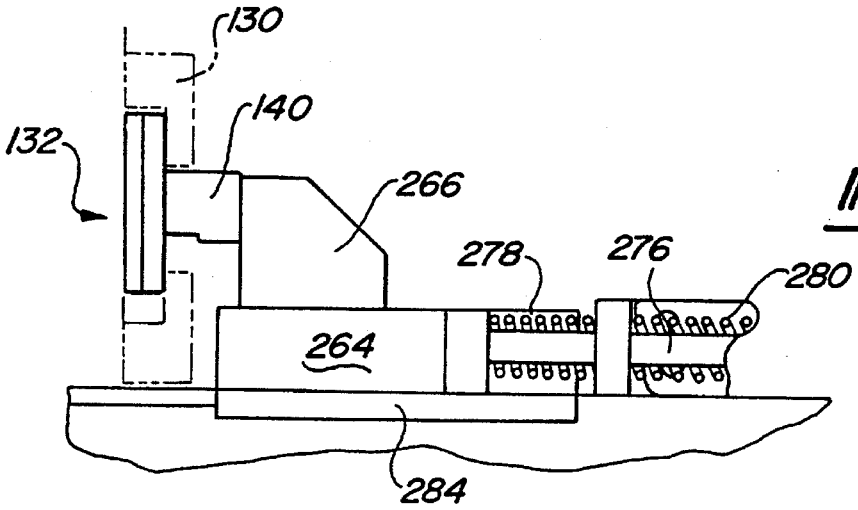
FIG. 16 is a side elevational view of the single push-pull chain shown in FIG. 15.
Figure 17:
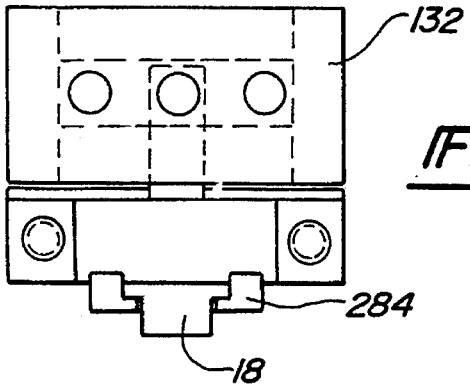
FIG. 17 is an end elevational view of the single push-pull chain shown in FIGS. 15 and 16.

FIGS. 15 through 17 illustrate a housing 260 which is connected to the end of chain 246 to allow the engagement of chain 246 with bolster 20. Housing 260 comprises a chain link 262, a slider 264 and an upright support bracket 266. Chain link 262 is pinned to the end of chain 246 using a cross pin 268. Chain link 262 includes a pair of holes 270 which enable chain link 262 to engage slider 264. Slider 264 is a generally rectangular member having a pair of wings 272 which each include a threaded hole 274. A connector bolt 276 extends through a respective hole 270 in chain link 262 and is threadingly received within a respective threaded hole 274. Each of a first pair of coil springs 278 is disposed around a respective bolt 276 and between chain link 262 and slider 264 to bias slider 264 away from chain link 262. Each of a second pair of coil springs 280 is disposed around a respective bolt 276 and between chain link 262 and a nut 282 threaded onto bolt 276 to bias slider 264 towards chain link 262. Slider 264 further includes a pair of L-shaped brackets 284 which engage track 18, as shown in FIG. 17, similar to the engagement of chain 246 with track 18. The engagement between track 18 and bracket 284 further adds to the stability of chain 246 to allow it to push bolster 20 and an associated die set. Support bracket 266 extends generally perpendicular to slider 264 and is fixedly secured to slider 264 by welding or by other means known well in the art.

Support bracket 266 is also fixedly secured to the rectangular shaped body 140 of male coupling 132 by welding or other means known well in the art. As described above, male coupling 132 is adapted for engagement with female coupling 130, shown in FIG. 16 in phantom, to facilitate the pushing and pulling of bolster 20. Coil springs 278 and 280 are provided to allow limited movement of male coupling 132 for alignment purposes when bolster 20 is moving transversely with respect to tracks 18.

Figure 18:
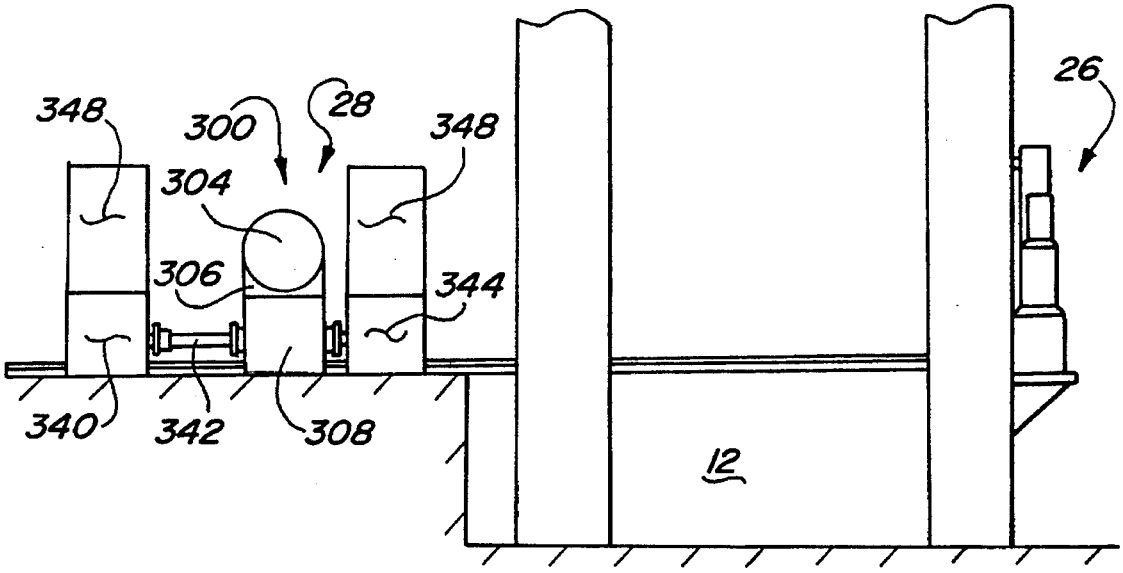
FIG. 18 is a side elevational view illustrating the double press-pull drive system in accordance with the present invention.

Referring now to FIG. 18, drive system 28 is comprised of a two speed oil-shear drive system 300 and a double push-pull drive apparatus 302. Drive system 28 is similar to drive system 26 with one of the differences being the change from a single push-pull chain to a double push-pull chain in order to accommodate the pushing and pulling of two bolsters 20 and their associated dies. Drive system 300 is mounted to the floor of the manufacturing plant and/or the supporting structure for tracks 24. Drive system 300 comprises a motor 304, a two speed oil-shear drive 306 and a reduction gear 308. Motor 304 and reduction gear 308 are well known in the art and will not be discussed in detail herein. Two speed oil-shear drive 306 is also more fully described in assignee's aforementioned U.S. patent application Ser. No. 08/059,585.

Figure 19:
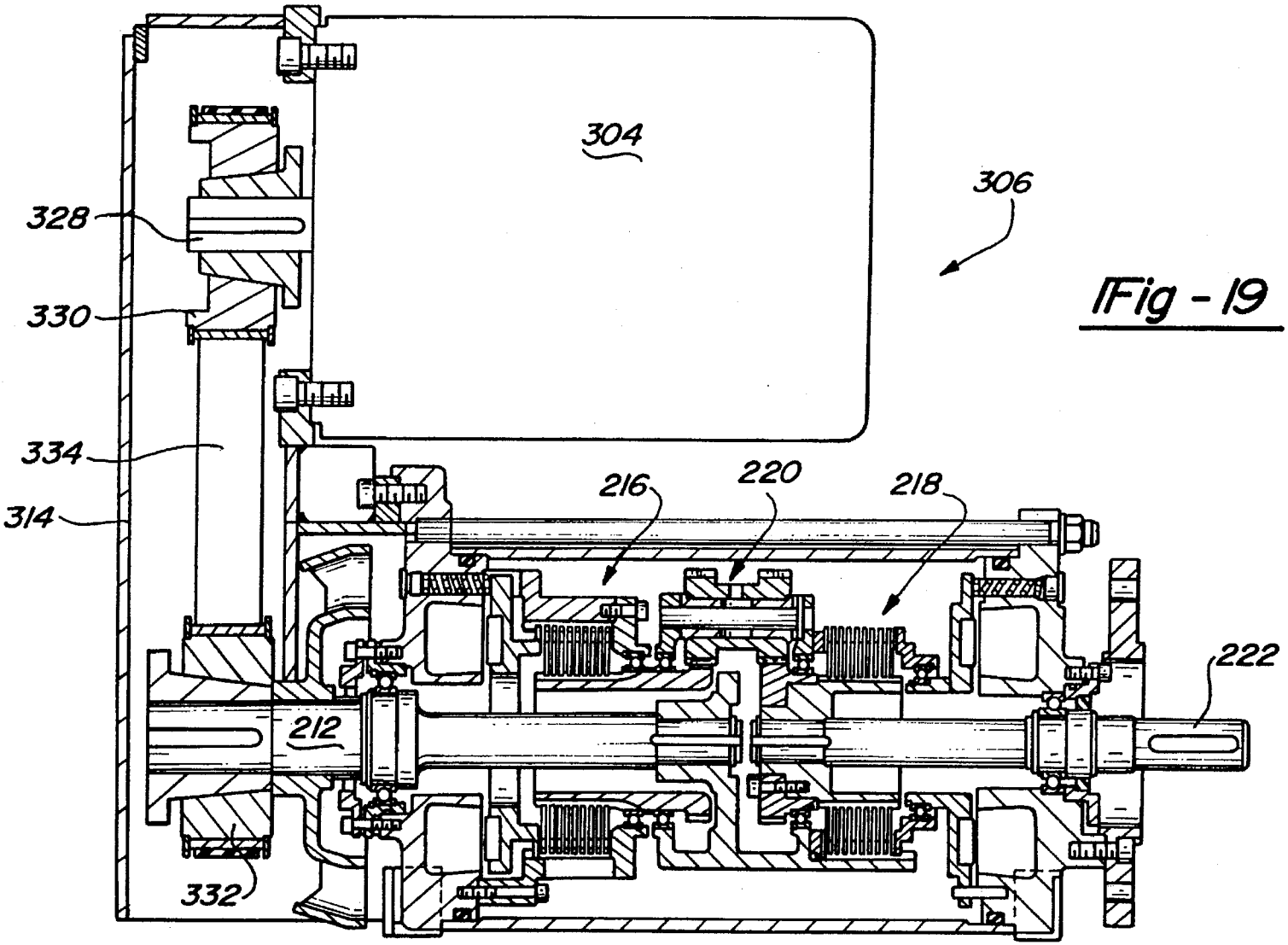
FIG. 19 is a side elevational view, partially in cross-section, of the two speed oil-shear drive illustrated in FIG. 18.

Referring now to FIG. 19, two speed oil-shear drive 306, similar to two speed drive 206 comprises input shaft 212, a housing assembly 314, brake/clutch assembly 216, brake/clutch assembly 218, planetary gear train 220 and output shaft 222. The difference between drive 306 and drive 206 is that housing assembly 214 has been replaced by housing assembly 314. Housing assembly 314 provides for a U-shaped drive system which provides a more compact drive system. Drive motor 304 has a drive shaft 328 which extends generally parallel to input shaft 212. A driving pulley 330 is fixedly secured to drive shaft 328 and a driven pulley 332 is fixedly secured to input shaft 212. A drive belt 334 extends between driving pulley 330 and driven pulley 332 to provide power from drive motor 304 to input shaft 212. Output shaft 222 drives reduction gear 308 and is secured to reduction gear 308 by means known well in the art. The high speed, low speed and braking operations of two speed oil-shear drive 306 are identical to that described above for two speed drive unit 206.

The output from reduction gear 308 drives a first drive sprocket 340, an intermediate drive shaft 342 and a second drive sprocket 344. Each drive sprocket 340 and 344 drives a respective double push-pull chain 346 to push and pull the pair of bolsters 20 along tracks 24. Each drive sprocket 340 and 344 includes a magazine 348 for the storage of chain 346 when it is not disposed along track 24.

Figure 20:
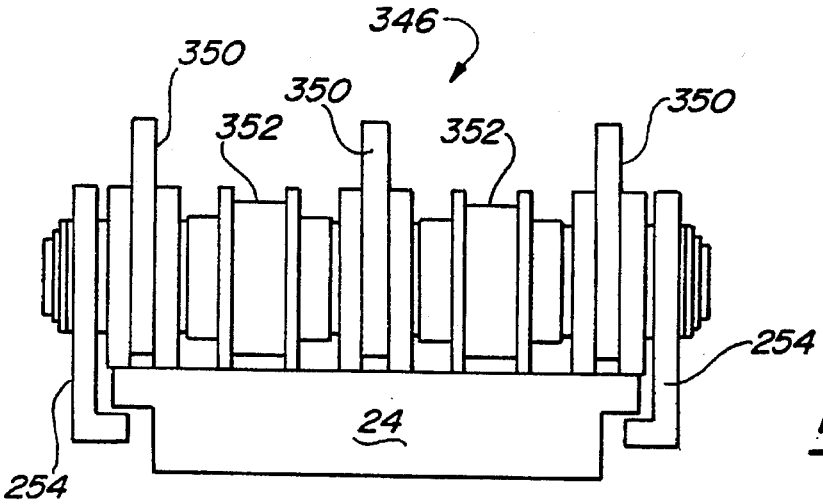
FIG. 20 is an end view taken along the tracks extending adjacent to the press shown in FIGS. 1 and 2 to illustrate the interface between the double push-pull chain and the tracks.

Referring now to FIG. 20, the construction of chain 346 is typical for a double chain having various links 350 and cross pieces 352 with the exception that chain 346 also includes L-shaped bracket 254 located at each side of chain 346 for engagement with track 24. Because chain 346 is a push-pull chain, engagement with track 24 is required to eliminate any buckling of chain 346 when it is pushing the pair of bolsters 20. L-shaped brackets 254, which are disposed along the entire length of chain 346, provide the required stability to chain 346 to allow it to push the pair of bolsters 20 and their associate die sets.

Figure 21:
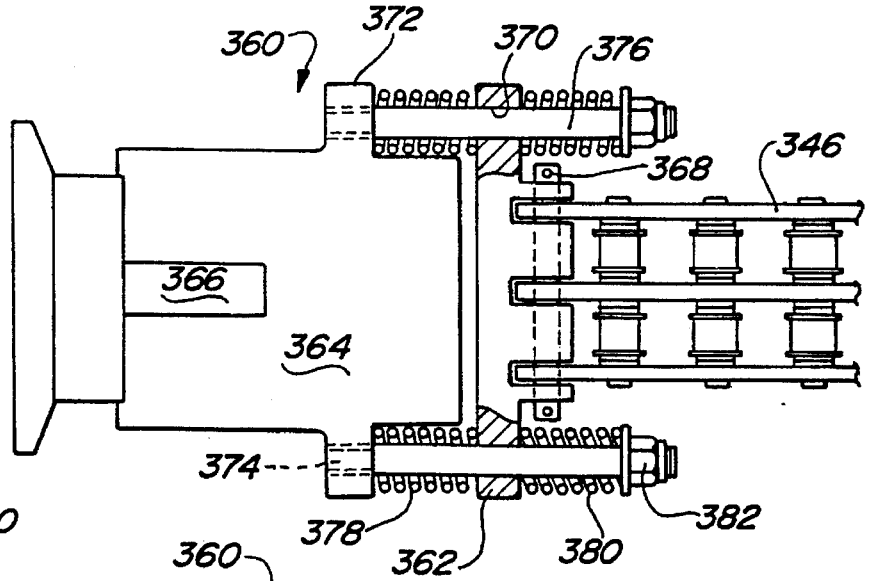
FIG. 21 is a plan view of the driving end of the double push-pull chain according to the present invention.
Figure 22:
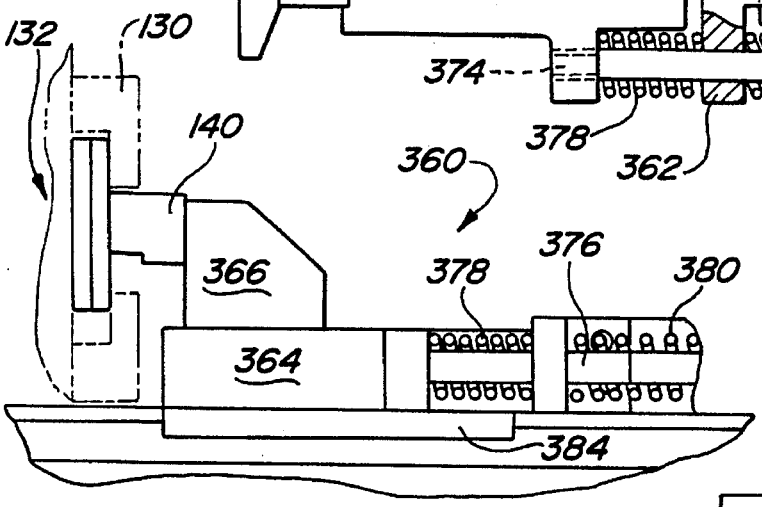
FIG. 22 is a side elevational view of the double push-pull chain shown in FIG. 21.
Figure 23:
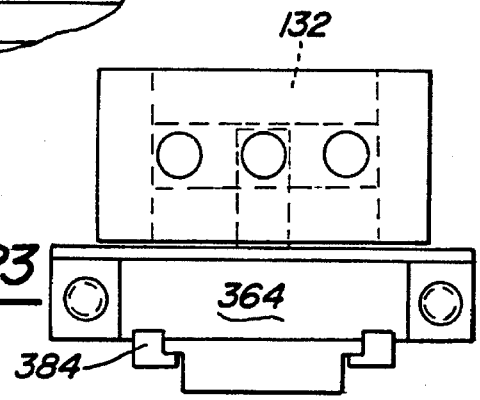
FIG. 23 is an end elevational view of the double push-pull chain shown in FIGS. 21 and 22.

FIGS. 21 through 23 illustrate a housing 360 which is connected to the end of chain 346 to allow the engagement of chain 346 with bolster 20. Housing 360 comprises a chain link 362, a slider 364 and an upright support bracket 366. Chain link 362 is pinned to the end of chain 346 using a cross-pin 368. Chain link 362 includes a pair of holes 370 which enable chain link 362 to engage slider 364. Slider 364 is a generally rectangular member having a pair of wings 372 which each include a threaded hole 374. A connecting bolt 376 extends through a respective hole 370 in chain link 362 and is threadingly received within a respective threaded hole 374. Each of a first pair of coil springs 378 is disposed around a respective bolt 376 and between chain link 362 and slider 364 to bias slider 364 away from chain link 362. Each of a second pair of coil springs 380 is disposed around a respective bolt 376 and between chain link 362 and a nut 382 threaded onto bolt 376 to bias slider 364 towards chain link 362. Slider 364 further includes a pair of L-shaped brackets 384 which engage track 24, as shown in FIG. 23, similar to the engagement of chain 346 with track 24. The engagement between track 24 and brackets 384 further adds to the stability of chain 346 to allow it to push the pair of bolsters and the associated die sets. Support bracket 366 extends generally perpendicular to slider 364 and is fixedly secured to slider 264 by welding or by other means known well in the art.

Support bracket 366 is also fixedly secured to the rectangular shaped body 140 of male coupling 132 by welding or by other means known well in the art. As described above, male coupling 132 is adapted for engagement with female coupling 130, shown in phantom in FIG. 22, to facilitate the pushing and pulling of the pair of bolsters 20. Coil springs 378 and 380 are provided to allow limited movement of male coupling 132 for alignment purposes when bolster 20 is moving transversely with respect to tracks 24.

The incorporation of two speed oil-shear drive 206 in drive system 26 and two speed oil-shear drive 306 in drive system 28 allow for the rapid movement of bolsters 20 during the major portion of their movement followed by slower movement of bolsters 20 as they approach their final destination due to the high and low speed operational characteristics of drives 206 and 306. This initial rapid or high speed movement of bolsters 20 followed by the slow or low speed positioning movement of bolsters 20 enables accurate positioning of bolsters 20 without the need for additional positioning systems which can significantly add to the costs of the die changing system.

While the above detailed description describes the preferred embodiment of the present invention, it should be understood that the present invention is susceptible to modification, variation and alteration without deviating from the scope and fair meaning of the subjoined claims.

What is claimed is:

1. A bolster for transporting a die set into a press, said bolster comprising:

a base; and at least one retractable roller assembly connected to said base, said roller assembly comprising:

a first housing connected to said base;

a second housing connected to said base;

a connecting rod extending between said first and second housings, said first housing being connected to said connecting rod, said second housing be movably mounted with respect to said connecting rod;

a retractable roller disposed between said first and second housings, said retractable roller being movable between a retracted and an extended position, said retractable roller supporting said bolster when said retractable roller is in said extended position;

a piston connected to said connecting rod, said piston and said second housing forming a fluid chamber; and means for selectively supplying pressurized fluid to said fluid chamber to move at least one of said first and second housings with respect to said base, said movement of said one housing locating said roller in said extended position.

2. The bolster according to claim 1 wherein, said first housing cammingly engages said retractable roller.

3. The bolster according to claim 2 wherein, said second housing cammingly engages said retractable roller.

4. The bolster according to claim 1 wherein, said first and said second housings move with respect to said retractable roller.

5. The bolster according to claim 4 wherein said first and said second housings cammingly engage said retractable roller.

6. The bolster according to claim 1 wherein, said press includes a first track and said retractable roller includes a flange for engagement with said first track.

7. The bolster according to claim 1 wherein, said pressurized fluid is pressurized hydraulic fluid.

8. The bolster according to claim 1 further comprising a biasing member for urging said retractable roller into said retracted position.

9. The bolster according to claim 1 further comprising at least one stationary roller assembly connected to said base.

10. The bolster according to claim 9 wherein, said press includes a second track and said stationary roller includes a flange for engagement with said second track.

11. The bolster according to claim 1 further comprising a biasing member for urging said first housing away from said second housing.

12. A die changing apparatus for a press, said press apparatus having an upright opening, said press including a first track extending through said upright opening and a second track mating with and extending generally perpendicular to said first track, said die changing apparatus comprising:

a first bolster having a retractable roller assembly for selectively engaging said first track and a stationary roller assembly for selectively engaging said second track;

a second bolster having a retractable roller assembly for selectively engaging said first track and a stationary roller assembly for selectively engaging said second track;

a first drive system for driving one of said first and second bolsters along said first track between a first position where said one bolster is located within said press and a second position where said one bolster is located outside of said press;

means for coupling said first drive system to said one bolster;

means for coupling said first bolster to said second bolster when said first bolster is disposed adjacent to said second bolster;

a second drive system for driving said first and second bolsters along said second track between a first position where said first bolster is in alignment with said first track and a second position where said second bolster is in alignment with said first track; and means for coupling said second drive system with one of said first and second bolsters.

13. The die changing apparatus according to claim 12 wherein, said said retractable roller assembly of said first bolster comprises:

a first housing connected to said bolster;

a second housing connected to said bolster;

a connecting rod extending between said first and second housings, said first housing being connected to said connecting rod, said second housing be movably mounted with respect to said connecting rod;

a retractable roller disposed between said first and second housings, said retractable roller being movable between a retracted and an extended position, said retractable roller supporting said bolster when said retractable roller is in said extended position;

a piston connected to said connecting rod, said piston and said second housing forming a fluid chamber; and means for selectively supplying pressurized fluid to said fluid chamber to move at least one of said first and second housings with respect to said base, said movement of said one housing locating said roller in said extended position.

14. The die changing apparatus according to claim 13 wherein, said first housing cammingly engages said retractable roller.

15. The die changing apparatus according to claim 14 wherein, said second housing cammingly engages said retractable roller.

16. The die changing apparatus according to claim 13 wherein, said first and said second housings move with respect to said retractable roller.

17. The die changing apparatus according to claim 16 wherein said first and said second housings cammingly engage said retractable roller.

18. The according to claim 13 wherein, said press includes a first track and said retractable roller includes a flange for engagement with said first track.

19. The die changing apparatus according to claim 13 wherein, said pressurized fluid is pressurized hydraulic fluid.

20. The die changing apparatus according to claim 13 further comprising a biasing member for urging said retractable roller into said retracted position.

21. The die changing apparatus according to claim 13 further comprising at least one stationary roller assembly connected to said base.

22. The die changing apparatus according to claim 21 wherein, said press includes a second track and said stationary roller includes a flange for engagement with said second track.

23. The die changing apparatus according to claim 13 further comprising a biasing member for urging said first housing away from said second housing.

24. A method of changing between a first die and a second die in a press, said first die being disposed on a first bolster inside said press, said second die being disposed on a second bolster outside said press, said method comprising the steps of:

coupling said first bolster to a first drive system;

coupling said second bolster to a second drive system;

extending at least one roller to rollingly support said first bolster on a first track;

actuating said first drive system to move said first bolster along said first track to position said first bolster in alignment with a second track, said first bolster coupling to said second bolster during said movement along said first track;

retracting said roller of said first bolster to rollingly support said first bolster on said second track;

actuating said second drive system to move said first and second bolsters along said second track to position said second bolster in alignment with said first track, said second bolster coupling to said first drive during said movement along said second track;

extending at least one roller to rollingly support said second bolster on said second track;

actuating said first drive system to move said second bolster along said first track and into said press; and retracting said roller of said second bolster to support said bolster in said press.

* * * * *

UNITED STATES PATENT AND TRADEMARK OFFICE

CERTIFICATE OF CORRECTION

PATENT NO. : 5,582,062

DATED : December 10, 1996

INVENTOR(S) : Gordon M. Sommer

It is certified that error appears in the above-indentified patent and that said Letters Patent is hereby corrected as shown below:

Title Page, [57] Abstract, line 3, "T-shape" should be --T-shaped--

Col. 2, line 66, "press-pull" should be --push-pull--

Col. 5, line 20, "secures" should be --secured--

Col. 5, line 55, "defining" should be --define--

Col. 7, line 2, "in" should be --is--

Col. 8, line 31, "shaft 222," should be --shaft 222.--

Col. 11, line 42, claim 1, "be" should be --being--

Col. 12, line 56, claim 13, "be" should be --being--

Col. 13, line 16, claim 18, after "the" insert --die changing apparatus--

Signed and Sealed this

Seventh Day of October, 1997

*Attest:*

Bruce Lehman

BRUCE LEHMAN

*Attesting Officer*

*Commissioner of Patents and Trademarks*